US009847595B2

(12) United States Patent
Tsai et al.

(10) Patent No.: US 9,847,595 B2
(45) Date of Patent: Dec. 19, 2017

(54) ELECTRICAL RECEPTACLE CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Rui Su, New Taipei (TW); Dong Xiang, New Taipei (TW); Long-Fei Chen, New Taipei (TW); Yun-Jhong Wong, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 15/389,923

(22) Filed: Dec. 23, 2016

(65) Prior Publication Data

US 2017/0187140 A1 Jun. 29, 2017

(30) Foreign Application Priority Data

Dec. 23, 2015 (CN) ..... 2015 2 1079338 U

(51) Int. Cl.

| | |
|---|---|
| ***H01R 13/648*** | (2006.01) |
| ***H01R 13/52*** | (2006.01) |
| ***H01R 13/6581*** | (2011.01) |
| ***H01R 24/60*** | (2011.01) |
| *H01R 107/00* | (2006.01) |

(52) U.S. Cl.

CPC ..... *H01R 13/521* (2013.01); *H01R 13/6581* (2013.01); *H01R 24/60* (2013.01); *H01R 2107/00* (2013.01)

(58) Field of Classification Search

CPC ..... H01R 13/521; H01R 13/5202; H01R 13/6581; H01R 24/60; H01R 2107/00

USPC ..... 439/607.01, 607.4, 589, 936

See application file for complete search history.

(56) References Cited

U.S. PATENT DOCUMENTS

| | | | | |
|---|---|---|---|---|
| 5,299,940 | A * | 4/1994 | Uenaka | H05K 5/0269 235/492 |
| 9,608,359 | B2 * | 3/2017 | Arai | H01R 12/716 |
| 9,660,399 | B2 * | 5/2017 | Hsu | H01R 24/60 |

* cited by examiner

*Primary Examiner* — Khiem Nguyen

(74) *Attorney, Agent, or Firm* — Muncy, Geissler, Olds & Lowe, P.C.

(57) ABSTRACT

An electrical receptacle connector includes a metallic shell, an insulated housing, first receptacle terminals, second receptacle terminals, first glue recess, and a first texture region. The metallic shell circularly encloses the insulated housing. The first and second receptacle terminals are held in the insulated housing. The first texture region is annularly formed on an inner wall of the metallic shell and corresponds to a periphery of the outer wall of the insulated housing. Therefore, the sealing member can attach onto the first texture region efficiently. Therefore, the sealing member does not overflow to the front portion of the receptacle cavity, and the inner gap can be sealed by the sealing member properly. Hence, the first texture region allows the sealing member to attach onto the inner wall of the shell body, and the sealing member can cover the inner gap completely to provide a reliable waterproof performance.

10 Claims, 11 Drawing Sheets

| | | | | | | | | | | | | | | | | |
|---|---|---|---|---|---|---|---|---|---|---|---|---|---|---|---|---|
| GND | TX1+ | TX1− | VBUS | CC1 | D+ | D− | SBU1 | VBUS | RX2− | RX2+ | GND | 31 |
| GND | RX1+ | RX1− | VBUS | SBU2 | D− | D+ | CC2 | VBUS | TX2− | TX2+ | GND | 41 |

FIG.4

ELECTRICAL RECEPTACLE CONNECTOR

CROSS-REFERENCE TO RELATED APPLICATION

This non-provisional application claims priority under 35 U.S.C. §119(a) to Patent Application No. 201521079338.7 filed in China, P.R.C. on Dec. 23, 2015, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. Therefore, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A conventional USB type-C electrical receptacle connector includes a plastic core, upper and lower receptacle terminals held on the plastic core, and an outer iron shell circularly enclosing the plastic core.

SUMMARY OF THE INVENTION

However, gaps may be formed between the outer iron shell and the plastic core of the conventional USB type-C connector. Commonly, waterproof glues are filled into the gaps for sealing and preventing water moist from penetrating into the interior of the connector. Nevertheless, the inner wall of the outer iron shell is smooth, and the waterproof glues will penetrate into the interior of the connector rather than attaching onto the inner wall of the outer iron shell when the waterproof glues are fed into the gaps. As a result, the gaps cannot be sealed properly and penetration of water moist still occurs. Therefore, how to solve the aforementioned problem is an issue.

In view of this, an embodiment of the instant disclosure provides an electrical receptacle connector. The electrical receptacle connector comprises a metallic shell, an insulated housing, a plurality of first receptacle terminals, a plurality of second receptacle terminals, and a first texture region. The metallic shell comprises a shell body and a receptacle cavity defined through the shell body. Two ends of the shell body are respectively formed as a front end and a rear end. The insulated housing is received in the receptacle cavity. The insulated housing comprises a base portion and a tongue portion extending from the one end of the base portion. An inner gap is formed between an inner wall of the shell body at the rear end and the base portion. The first receptacle terminals comprise a plurality of first signal terminals, at least one first power terminal, and at least first ground terminal. The first receptacle terminals are held in the base portion and the tongue portion. The second receptacle terminals comprise a plurality of second signal terminals, at least one second power terminal, and at least one second ground terminal. The second receptacle terminals are held in the base portion and the tongue portion. The first texture region is annularly formed on the inner wall of the shell body. The first texture region corresponds to a periphery of an outer wall of the base portion and is distributed within the inner gap.

In one embodiment, an end portion of the shell body at the rear end is protruding from a lateral surface of the base portion to form a first glue recess. In addition, the electrical receptacle connector further comprises a sealing member filled in the first glue recess. The sealing member penetrates into the inner gap and fills the first texture region. Moreover, the metallic shell further comprises a case circularly enclosing the shell body.

In one embodiment, the electrical receptacle connector further comprises an enveloping shell circularly enclosing the shell body. An end portion of the enveloping shell corresponding to the rear end of the shell body is protruding from the lateral surface of the base portion to form a second glue recess. Furthermore, the electrical receptacle connector further comprises a sealing member filled in the second glue recess. The sealing member penetrates into the inner gap and fills the first texture region.

In one embodiment, an outer gap is formed between an inner wall of the enveloping shell corresponding to the rear end of the shell body and an outer wall of the shell body. Furthermore, the electrical receptacle connector further comprises a second texture region. The second texture region is annularly formed on an outer wall of the shell body. The second texture region corresponds to an inner wall of the enveloping shell and is distributed within the outer gap. Moreover, the electrical receptacle connector further comprises a sealing member filled in the second glue recess. The sealing member penetrates into the outer gap and fills the second texture region.

Another embodiment of the instant disclosure provides an electrical receptacle connector. The electrical receptacle connector comprises a metallic shell, an insulated housing, a plurality of first receptacle terminals, a plurality of second receptacle terminals, and an enveloping shell. The metallic shell comprises a shell body and a receptacle cavity defined through the shell body. Two ends of the shell body are respectively formed as an front end and a rear end. The insulated housing is received in the receptacle cavity. The insulated housing comprises a base portion and a tongue portion extending from one end of the base portion. The base portion is located at an end portion of the shell body. The rear end of the shell body is protruding from a lateral surface of the base portion to form a first glue recess. The first receptacle terminals are held in the base portion and the tongue portion. The second receptacle terminals are held in the base portion and the tongue portion. The enveloping shell circularly encloses the shell body. An end portion of the enveloping shell corresponding to the rear end of the shell body is protruding from the lateral surface of the base portion to form a second glue recess. The second glue recess comprises the first glue recess.

As above, the first texture region makes the inner wall of the metallic shell form a rough surface, so that the sealing member can attach onto the first texture region efficiently. Therefore, the sealing member does not overflow into the front portion of the receptacle cavity, and the inner gap can be sealed by the sealing member properly. Hence, the first texture region allows the sealing member to attach onto the inner wall of the shell body, and the sealing member can cover the inner gap completely to provide a reliable waterproof performance. Furthermore, the second texture region make the outer wall of the shell body form a rough surface, so that the sealing member can attach onto the second texture region efficiently. Therefore, the sealing member does not overflow into the front portion of the receptacle cavity, and the outer gap can be sealed by the sealing member properly. Hence, the second texture region allows the sealing member to attach onto the outer wall of the shell body, and the sealing member can cover the outer gap completely to provide a reliable waterproof performance.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180-degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 4 illustrates a schematic configuration diagram of the receptacle terminals of the electrical receptacle connector shown in FIG. 3;

DETAILED DESCRIPTION

Figure 1:
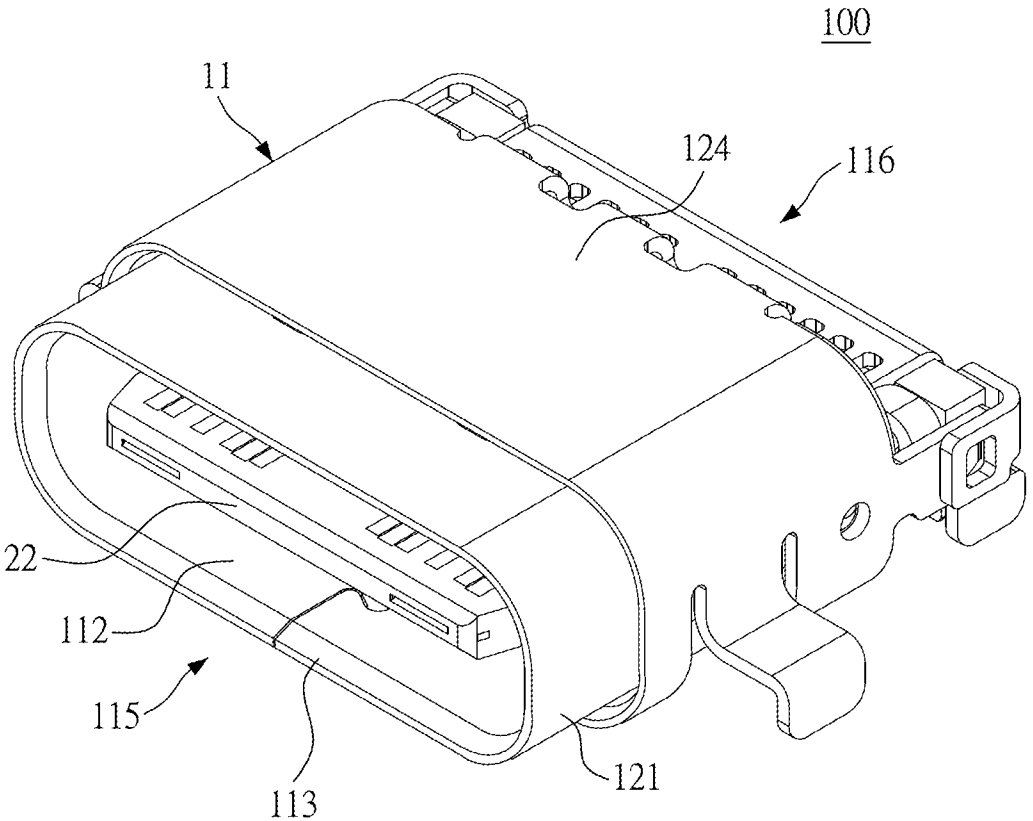
FIG. 1 illustrates a perspective view of an electrical receptacle connector according to a first embodiment of the instant disclosure.

Please refer to FIG. 1, illustrating an electrical receptacle connector of a first embodiment of the instant disclosure. FIG. 1 illustrates a perspective view of an electrical receptacle connector according to the first embodiment of the instant disclosure. In this embodiment, the electrical receptacle connector 100 is mounted on a circuit board in a sinking type for performing a low profile configuration. That is, one side of the circuit board is cut to form a notch, and the electrical receptacle connector 100 is mounted within the notch and a side portion of the circuit board, but embodiments are not limited thereto. In this embodiment, the electrical receptacle connector 100 can provide a reversible or dual orientation USB Type-C connector interface and pin assignments, i.e., a USB Type-C receptacle connector. In this embodiment, the electrical receptacle connector 100 comprises a metallic shell 11, an insulated housing 2, a plurality of first receptacle terminals 31, a plurality of second receptacle terminals 41, and a first texture region 51.

Figure 2:
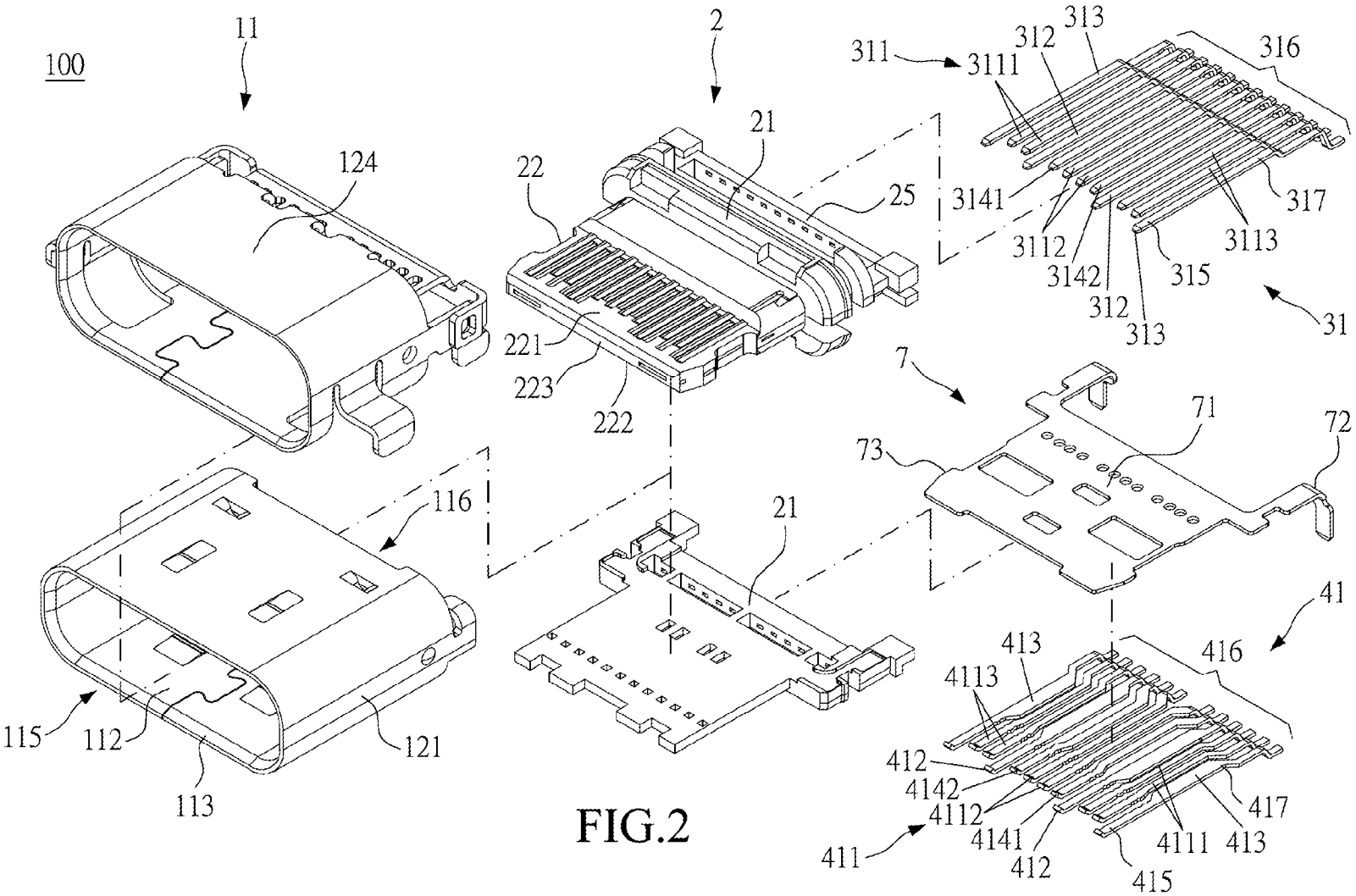
FIG. 2 illustrates an exploded view of the electrical receptacle connector.

Please refer to FIG. 2, illustrating an exploded view of the electrical receptacle connector of the first embodiment. The metallic shell 11 is a hollowed shell, and the metallic shell 11 comprises a shell body 121 and a receptacle cavity 112 formed in and defined through the shell body 121. Two ends of the shell body 121 are respectively formed as a front end 115 and a rear end 116. The front end 115 is adapted to be mated with an electrical plug connector. Tail portions 316 of the first receptacle terminals 31 and tail portions 416 of the second receptacle terminals 41 are located near the rear end 116 and adapted to be soldered on a circuit board. In this embodiment, the shell body 121 may be a tubular member and the receptacle cavity 112 is formed in the tubular member. The metallic shell 11 may be formed by a multi-piece member; in such embodiment, the metallic shell 11 comprises a case 124 circularly enclosing the shell body 121. The shell body 121 may be a seamless and hollowed tubular member formed by deep drawing technique; alternatively, the shell body 121 may be a seamed and hollowed tubular member formed by bending a metallic plate. In addition, the case 124 may be a semi-tubular member with a U-shape cross section, and the case 124 covers the top and the two sides of the shell body 121 to be formed as an outer shell structure. In addition, an insertion opening 113 with oblong shaped is formed on the front end 115 of the shell body 121, and the insertion opening 113 communicates with the receptacle cavity 112.

Please refer to FIG. 2. In this embodiment, the insulated housing 2 is received in the receptacle cavity 112. The insulated housing 2 comprises a base portion 21 and a tongue portion 22. In this embodiment, the tongue portion 22 is extending from the base portion 21. An inner gap 211 is formed between an inner wall 121*a* of the shell body 121 at the rear end 116 of the shell body 121 and the base portion 21.

Please refer to FIG. 2. In this embodiment, the insulated housing 2 further comprises a first portion and a second portion. The second portion is assembled with the first portion to form the insulated housing 2. That is, the first portion and the second portion can be assembled with each other to form the base portion 21 and the tongue portion 22. In addition, the base portion 21 may be integrally formed with the tongue portion 22 by injection molding. Furthermore, a shielding plate 7 is assembled or molded inside the base portion 21 and the tongue portion 22. In this embodiment, the first portion is insert-molded with the first receptacle terminals 31, and the second portion is insert-molded with the second receptacle terminals 41.

Figure 5:
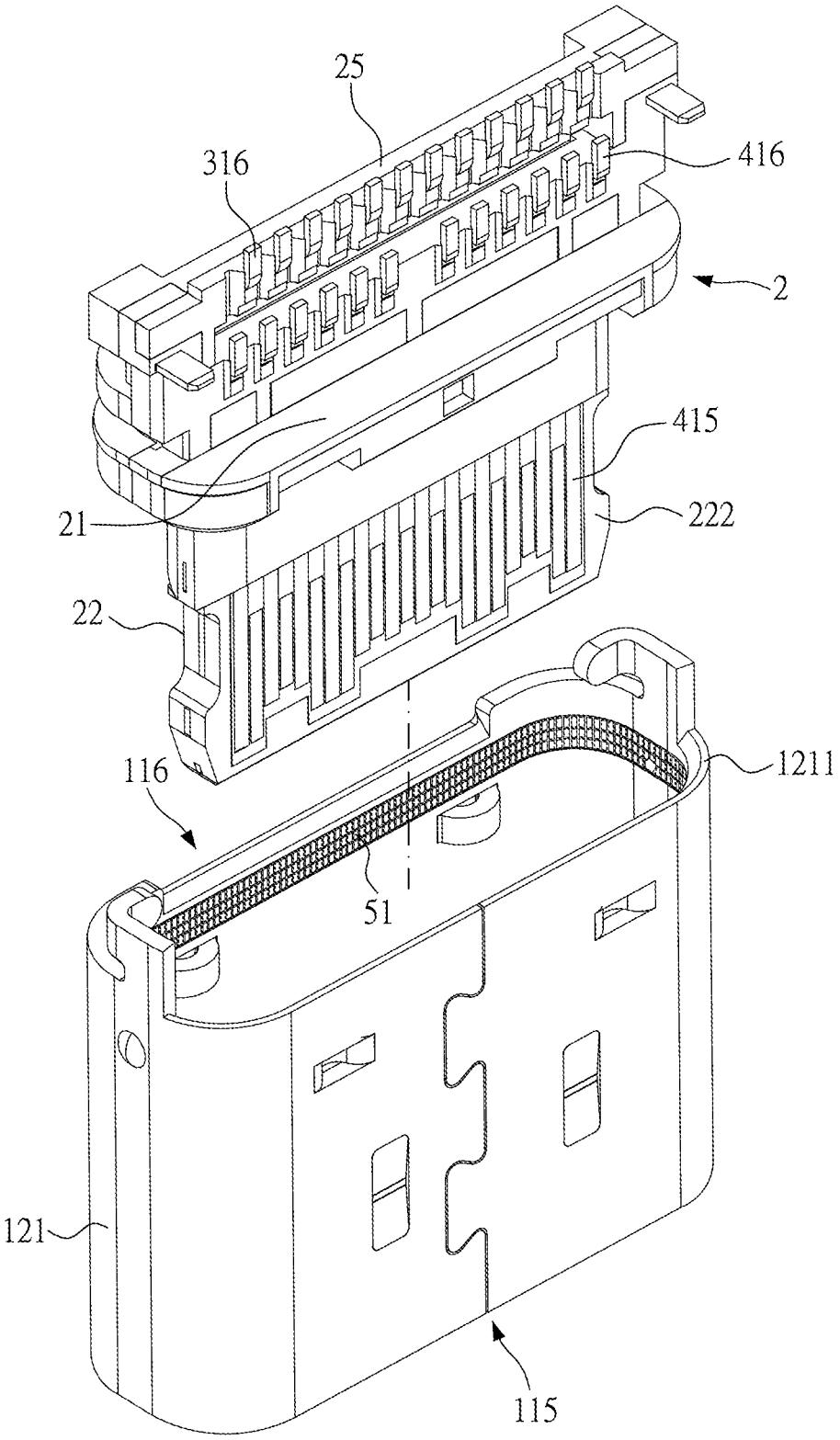
FIG. 5 illustrates another exploded view of the electrical receptacle connector.
Figure 6:
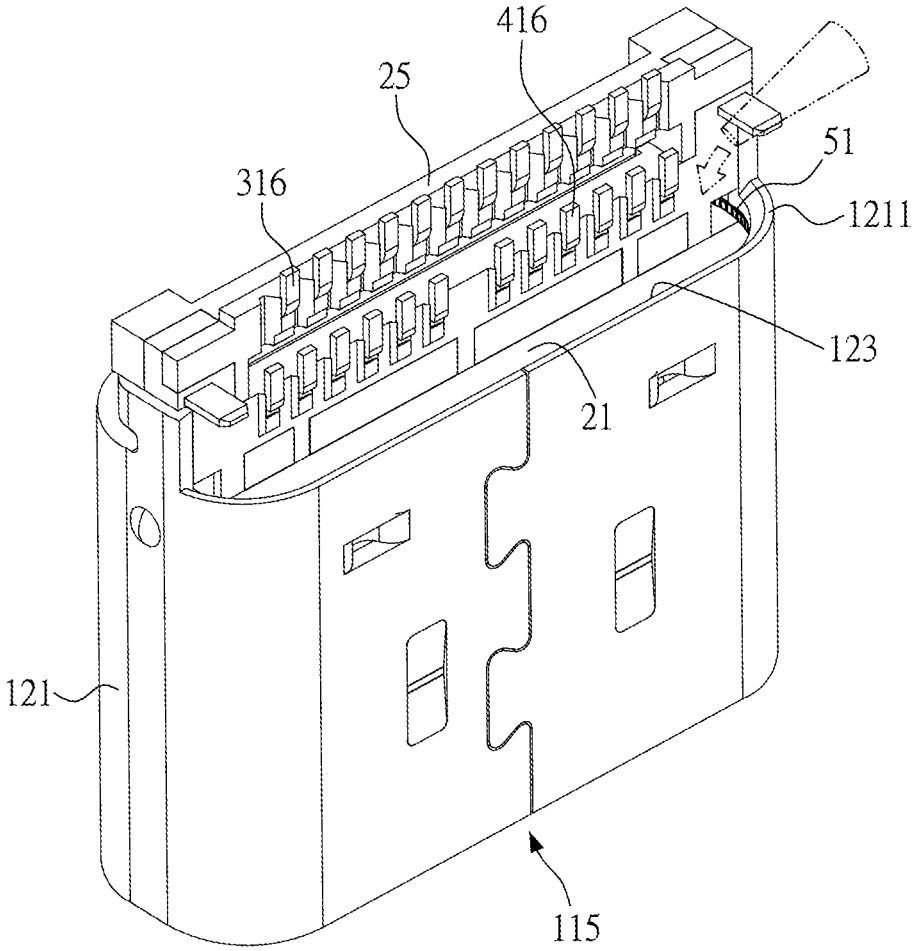
FIG. 6 illustrates another perspective view of the electrical receptacle connector.

Please refer to FIGS. 2, 5, and 6. FIG. 5 illustrates another exploded view of the electrical receptacle connector of the first embodiment. FIG. 6 illustrates another perspective view of the electrical receptacle connector of the first embodiment. In this embodiment, the tongue portion 22 is located at a front portion of the receptacle cavity 112, and the base portion 21 is located at a rear portion of the receptacle cavity 112. An end portion 1211 of the shell body 121 at the rear end 116 is protruded from a lateral surface of the base portion 21 to form a first glue recess 123. In other words, the rear lateral surface of the base portion 21 does not flush with the rear edge of the shell body 121, and a cross section of the base portion 21 and the shell body 121 forms an E shape without middle bar when the base portion 21 is received in the receptacle cavity 112.

Figure 3:
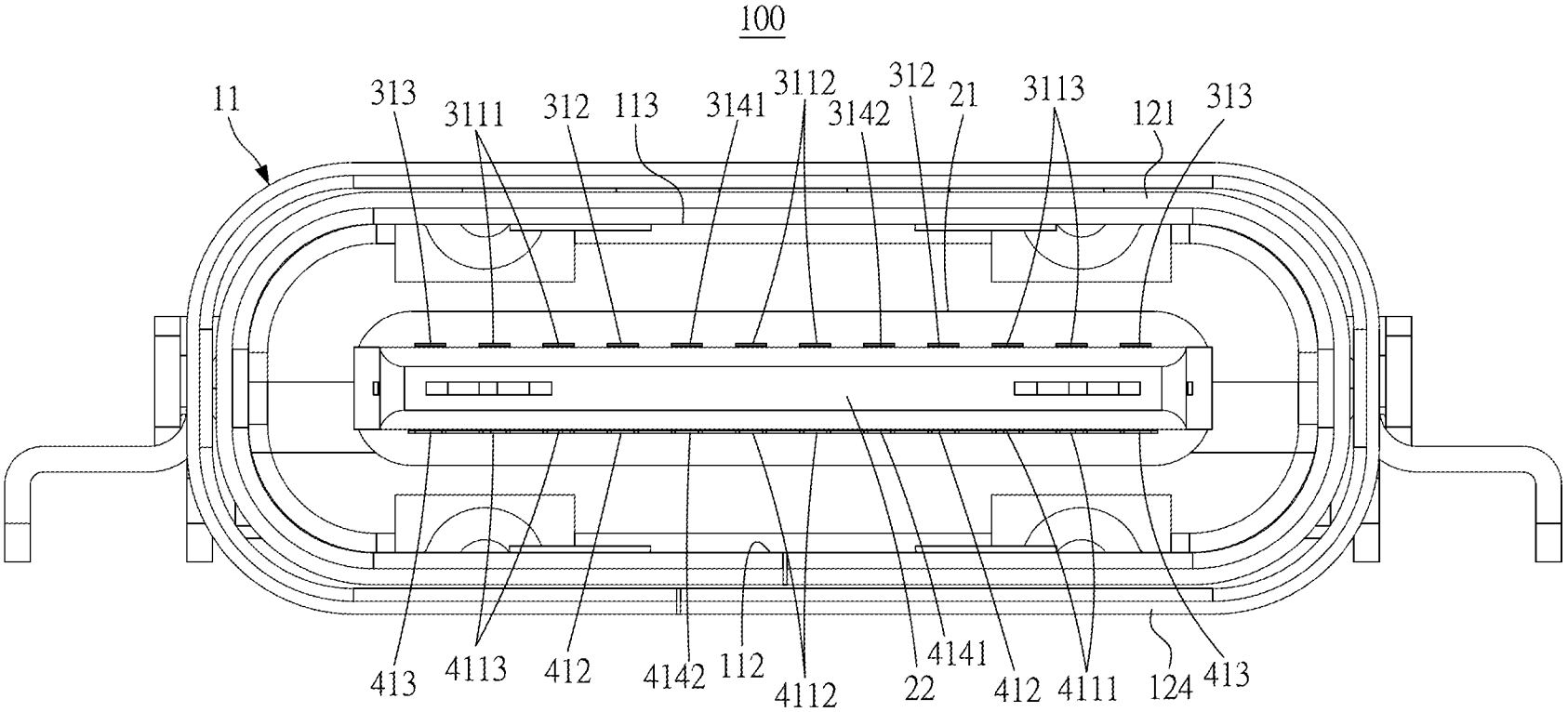
FIG. 3 illustrates a front view of the electrical receptacle connector.

Please refer to FIGS. 2 and 3. FIG. 3 illustrates a front view of the electrical receptacle connector of the first embodiment. The tongue portion 22 has two opposite surfaces, one is a first surface 221, and the other is the second surface 222. In addition, a front lateral surface 223 of the tongue portion 22 is respectively connected with the first surface 221 and the second surface 222 and is close to the insertion opening 113. In other words, the front lateral surface 223 is near the insertion opening 113 and perpendicularly connected to the first surface 221 and the second surface 222, respectively.

Please refer to FIGS. 5 and 6. In this embodiment, the insulated housing 2 further comprises a rear plate 25 extended outward from the middle portion of the rear of the base portion 21. In addition, the rear plate 25 is protruded out of the receptacle cavity 112 from the first glue recess 123, so that the first glue recess 123 forms an annular channel. The bottom surface of the annular channel is formed by the surface of the base portion 21, and the lateral surfaces of the annular channel are formed by the rear plate 25 and the shell body 121, respectively. The base portion 21, the rear plate 25, and the shell body together define the annular channel.

Figure 7:
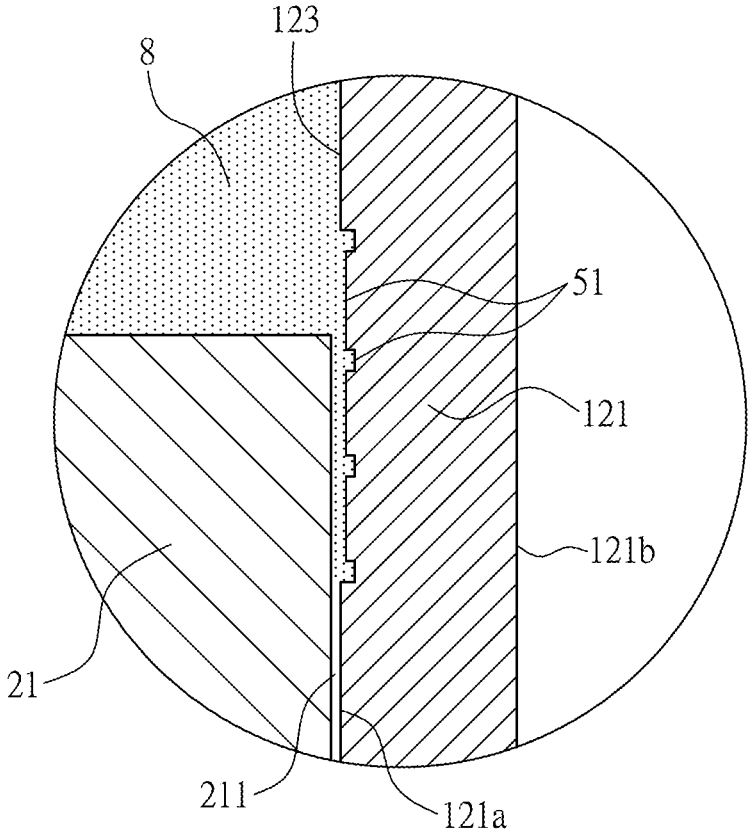
FIG. 7 illustrates an enlarged lateral view of the first texture region of the electrical receptacle connector of the first embodiment.

Please refer to FIGS. 5 to 7. FIG. 7 illustrates an enlarged lateral view of the first texture region of the electrical receptacle connector of the first embodiment. In this embodiment, the first texture region 51 is annularly formed on the inner wall 121*a* of the shell body 121. The first texture region 51 corresponds to a periphery of an outer wall of the base portion 21 and is distributed within the inner gap 121*a*. The first texture region 51 may be patterns formed by pressing techniques and may be aligned equidistantly or unequidistantly. The first texture region 51 may be aligned parallel (not overlapped) or nonparallel (overlapped), and the shape of the first texture region 51 may be rectangle, triangle, etc. It is understood that, the width of the first texture region 51 and the roughness of the pattern on the first texture region 51 can be altered according to glues with different viscosities.

Please refer to FIGS. 5 to 7. The first glue recess 123 is for filling a sealing member 8 in liquid state. The sealing member 8 penetrates the annular channel and makes the rear portion of the insulated housing 2 be filled with the sealing member 8, so that the inner gap 211 is completely sealed by the sealing member 8. In other words, the sealing member 8 is filled in the first glue recess 123, and the sealing member 8 penetrates into the inner gap 211 and fills the first texture region 51. The first texture region 51 makes the inner wall 121*a* of the metallic shell 11 form a rough surface, so that the sealing member 8 can attach onto the first texture region 51 efficiently. Therefore, the sealing member 8 does not overflow into the front portion of the receptacle cavity 112, and the inner gap 211 can be sealed by the sealing member 8 properly. Hence, the first texture region 51 allows the sealing member 8 to attach onto the inner wall 121*a* of the shell body 121, and the sealing member 8 can cover the inner gap 211 completely to provide a reliable waterproof performance.

Please refer to FIGS. 5 to 7. In this embodiment, the sealing member 8 is a waterproof glue block formed by drying and solidifying a liquid. Before the sealing member 8 is dried and set, the sealing member 8 fills into the inner gap 211 and the first glue recess 123, penetrates into the channel, and fills the rear portion of the receptacle cavity 112. Moreover, the sealing member also covers a gap between the rear lateral surface of the base portion 21 and the inner wall 121*a* of the shell body 121. Accordingly, water moist cannot enter into the receptacle cavity 112 and the rear portion of the metallic shell 11 from the insertion opening 113 at the front portion of the metallic shell 11. Therefore, when the electrical receptacle connector 100 is provided as a receptacle of an electronic device, water moist cannot enter into the electronic device and would not affect the operation of electronic components on a circuit board of the electronic device.

Please refer to FIGS. 2 to 4. FIG. 4 illustrates a schematic configuration diagram of the receptacle terminals of the electrical receptacle connector shown in FIG. 3. The first receptacle terminals 31 comprise a plurality of first signal terminals 311, at least one power terminal 312, and at least one ground terminal 313. From a front view of the first receptacle terminals 31, the first receptacle terminals 31 comprise, from left to right, a ground terminal 313 (Gnd), a first pair of first signal terminals 3111 (TX1+−, differential signal terminals for high-speed signal transmission), a power terminal 312 (Power/VBUS), a first function detection terminal 3141 (CC1, a terminal for inserting orientation detection of the connector and for cable recognition), a second pair of first signal terminals 3112 (D+−, differential signal terminals for low-speed signal transmission), a first supplement terminal 3142 (SBU1, a terminal can be reserved for other purposes), another power terminal 312 (Power/VBUS), a third pair of first signal terminals 3113 (RX2+−, differential signal terminals for high-speed signal transmission), and another ground terminal 313 (Gnd). In this embodiment, twelve first receptacle terminals 31 are provided for transmitting USB 3.0 signals. In some embodiments, the rightmost ground terminal 313 (Gnd) (or the leftmost ground terminal 313 (Gnd)) or the first supplement terminal 3142 (SBU1) can be further omitted. Therefore, the total number of the first receptacle terminals 31 can be reduced from twelve terminals to seven terminals. Furthermore, the ground terminal 313 (Gnd) may be replaced by a power terminal 312 (Power/VBUS) and provided for power transmission. In this embodiment, the width of the power terminal 312 (Power/VBUS) may be, but not limited to, equal to the width of the first signal terminal 311. In some embodiments, the width of the power terminal 312 (Power/VBUS) may be greater than the width of the first signal terminal 311 and an electrical receptacle connector 100 having the power terminal 312 (Power/VBUS) can be provided for large current transmission.

Please refer to FIGS. 2 to 4. The first receptacle terminals 31 are held in the base portion 21 and the tongue portion 22 and formed as the upper-row terminals of the electrical receptacle connector 100. In this embodiment, the first receptacle terminals 31 are assembled with the first portion. Each of the first receptacle terminals 31 comprises a flat contact portion 315, a body portion 317, and a tail portion 316. For each of the first receptacle terminals 31, the body portion 317 is held in the base portion 21 and the tongue portion 22, the flat contact portion 315 is extending forward from the body portion 317 in the rear-to-front direction and partly exposed upon the first surface 221 of the tongue portion 22, and the tail portion 316 is extending backward from the body portion 317 in the front-to-rear direction and protruding from the base portion 21. The first signal terminals 311 are disposed on the first surface 221 and transmit first signals (namely, USB 3.0 signals). The tail portions 316 are protruding from the bottom surface of the base portion 21. In addition, the tail portions 316 are bent horizontally to form flat legs, named legs manufactured by SMT (surface mounted technology), which can be mounted or soldered on the surface of a printed circuit board by using surface mount technology. Alternatively, the tail portions 316 may be extending downwardly to form vertical legs, named legs manufactured by through-hole technology, which can be inserted into holes drilled in a printed circuit board (PCB).

Please refer to FIGS. 2 to 4. The second receptacle terminals 41 comprise a plurality of second signal terminals 411, at least one power terminal 412, and at least one ground terminal 413. From a front view of the second receptacle terminals 41, the second receptacle terminals 41 comprise, from right to left, a ground terminal 413 (Gnd), a first pair of second signal terminals 4111 (TX2+−, differential signal terminals for high-speed signal transmission), a power terminal 412 (Power/VBUS), a second function detection terminal 4141 (CC2, a terminal for inserting orientation detection of the connector and for cable recognition), a second pair of second signal terminals 4112 (D+−, differential signal terminals for low-speed signal transmission), a second supplement terminal 4142 (SBU2, a terminal can be reserved for other purposes), another power terminals 412 (Power/VBUS), a third pair of second signal terminals 4113 (RX1+−, differential signal terminals for high-speed signal transmission), and another ground terminal 413 (Gnd). In this embodiment, twelve second receptacle terminals 41 are provided for transmitting USB 3.0 signals. In some embodiments, the rightmost ground terminal 413 (or the leftmost ground terminal 413) or the second supplement terminal 4142 (SBU2) can be further omitted. Therefore, the total number of the second receptacle terminals 41 can be reduced from twelve terminals to seven terminals. Furthermore, the rightmost ground terminal 413 may be replaced by a power terminal 412 and provided for power transmission. In this embodiment, the width of the power terminal 412 (Power/VBUS) may be, but not limited to, equal to the width of the second signal terminal 411. In some embodiments, the width of the power terminal 412 (Power/VBUS) may be greater than the width of the second signal terminal 411 and an electrical receptacle connector 100 having the power terminal 412 (Power/VBUS) can be provided for large current transmission.

Please refer to FIGS. 2 to 4. The second receptacle terminals 41 are held in the base portion 21 and the tongue portion 22 and formed as the lower-row terminals of the electrical receptacle connector 100. In this embodiment, the second receptacle terminals 41 are assembled with the second portion. The first receptacle terminals 31 are substantially aligned parallel with the second receptacle terminals 41 and farer from the end portion of the tongue portion 22 (as compared with the second receptacle terminals 41). Each of the second receptacle terminals 41 comprises a flat contact portion 415, a body portion 417, and a tail portion 416. For each of the second receptacle terminals 41, the body portion 417 is held in the base portion 21 and the tongue portion 22, the flat contact portion 415 is extending from the body portion 417 in the rear-to-front direction and partly exposed upon the second surface 222 of the tongue portion 22, and the tail portion 416 is extending backward from the body portion 417 in the front-to-rear direction and protruding from the base portion 21. The second signal terminals 411 are disposed at the second surface 222 and transmit second signals (i.e., USB 3.0 signals). In addition, the tail portions 416 are bent horizontally to form flat legs, named legs manufactured by SMT (surface mounted technology), which can be mounted or soldered on the surface of a printed circuit board by using surface mount technology. Alternatively, the tail portions 416 may be extending downwardly to form vertical legs, named legs manufactured by through-hole technology, which can be inserted into holes drilled in a printed circuit board (PCB).

Please refer to FIGS. 2 to 4. In this embodiment, the first receptacle terminals 31 and the second receptacle terminals 41 are disposed upon the first surface 221 and the second surface 222 of the tongue portion 22, respectively, and pin-assignments of the first receptacle terminals 31 and the second receptacle terminals 41 are point-symmetrical with a central point of the receptacle cavity 112 as the symmetrical center. In other words, pin-assignments of the first receptacle terminals 31 and the second receptacle terminals 41 have 180-degree symmetrical design with respect to the central point of the receptacle cavity 112 as the symmetrical center. The dual or double orientation design enables an electrical plug connector to be inserted into the electrical receptacle connector 100 in either of two intuitive orientations, i.e., in either upside-up or upside-down directions. Here, point-symmetry means that after the first receptacle terminals 31 (or the second receptacle terminals 41), are rotated by 180 degrees with the symmetrical center as the rotating center, the first receptacle terminals 31 and the second receptacle terminals 41 are overlapped. That is, the rotated first receptacle terminals 31 are arranged at the position of the original second receptacle terminals 41, and the rotated second receptacle terminals 41 are arranged at the position of the original first receptacle terminals 31. In other words, the first receptacle terminals 31 and the second receptacle terminals 41 are arranged upside down, and the pin assignments of the flat contact portions 315 are left-right reversal with respect to that of the flat contact portions 415. An electrical plug connector is inserted into the electrical receptacle connector 100 with a first orientation where the first surface 221 is facing up, for transmitting first signals. Conversely, the electrical plug connector is inserted into the electrical receptacle connector 100 with a second orientation where the first surface 221 is facing down, for transmitting second signals. Furthermore, the specification for transmitting the first signals is conformed to the specification for transmitting the second signals. Note that, the inserting orientation of the electrical plug connector is not limited by the electrical receptacle connector 100 according embodiments of the instant disclosure.

Please refer to FIGS. 2 to 4. In this embodiment, the position of the first receptacle terminals 31 corresponds to the position of the second receptacle terminals 41.

Additionally, in some embodiments, the electrical receptacle connector 100 is devoid of the first receptacle terminals 31 (or the second receptacle terminals 41) when an electrical plug connector to be mated with the electrical receptacle connector 100 has upper and lower plug terminals. In the case that the first receptacle terminals 31 are omitted, the upper plug terminals or the lower plug terminals of the electrical plug connector are in contact with the second receptacle terminals 41 of the electrical receptacle connector 100 when the electrical plug connector is inserted into the electrical receptacle connector 100 with the dual orientations. Conversely, in the case that the second receptacle terminals 41 are omitted, the upper plug terminals or the lower plug terminals of the electrical plug connector are in contact with the first receptacle terminals 31 of the electrical receptacle connector 100 when the electrical plug connector is inserted into the electrical receptacle connector 100 with the dual orientations.

Please refer to FIGS. 2 to 4. In this embodiment, the tail portions 316, 416 are protruding from the base portion 21 and arranged separately. The tail portions 316, 416 may be arranged into two parallel rows. Alternatively, the tail portions 416 may be aligned into two rows and the first row of the tail portions 416 is aligned by an offset with respect to the second row of the tail portions 416; thus, the tail portions 316, 416 form three rows.

Please refer to FIGS. 2 to 4. In this embodiment, as viewed from the front of the receptacle terminals 31, 41, the position of the first receptacle terminals 31 corresponds to the position of the second receptacle terminals 41. In other words, the positions of the flat contact portions 315 are respectively aligned with the positions of the flat contact portions 415, but embodiments are not limited thereto. In some embodiments, the first receptacle terminals 31 may be aligned by an offset with respect to the second receptacle terminals 41. That is, the flat contact portions 315 are aligned by an offset with respect to the flat contact portions 415. Accordingly, because of the offset alignment of the flat contact portions 315, 415, the crosstalk between the first receptacle terminals 31 and the second receptacle terminals 41 can be reduced during signal transmission. It is understood that, when the receptacle terminals 31, 41 of the electrical receptacle connector 100 have the offset alignment, plug terminals of an electrical plug connector to be mated with the electrical receptacle connector 100 would also have the offset alignment. Hence, the plug terminals of the electrical plug connector can be in contact with the receptacle terminals 31, 41 of the electrical receptacle connector 100 for power or signal transmission.

In the foregoing embodiments, the receptacle terminals 31, 41 are provided for transmitting USB 3.0 signals, but embodiments are not limited thereto. In some embodiments, for the first receptacle terminals 31 in accordance with transmission of USB 2.0 signals, the first pair of the first signal terminals 3111 (TX1+−) and the third pair of the first signal terminals 3113 (RX2+−) are omitted, and the second pair of the first signal terminals 3112 (D+−) and the power terminals 312 (Power/VBUS) are retained. While for the second receptacle terminals 41 in accordance with transmission of USB 2.0 signals, the first pair of the second signal terminals 4111 (TX2+−) and the third pair of the second signal terminals 4113 (RX1+−) are omitted, and the second pair of the second signal terminals 4112 (D+−) and the power terminals 412 (Power/VBUS) are retained.

Please refer to FIGS. 2 and 3. In some embodiment, the electrical receptacle connector 100 further comprises a shielding plate 7. The shielding plate 7 is held in the insulated housing 2. The shielding plate 7 comprises a plate body 71 and a plurality of contact parts 72. The plate body 71 is between the flat contact portions 315 of the first receptacle terminals 31 and the flat contact portions 415 of the second receptacle terminals 41. In other words, the plate body 71 is formed in the base portion 21 and the tongue portion 22 and between the flat contact portion 315 and the flat contact portions 415. The contact parts 72 may be extending downwardly from two sides of the plate body 71 and out of the bottom of the base portion 21, and the contact parts 72 are in contact with contacts of the circuit board. Alternatively, the contact parts 72 may be extending backwardly from two sides of the plate body 71 and out of the rear portion of the base portion 21, and the contact parts 72 are in contact with the metallic shell 11. Accordingly, the crosstalk interference can be reduced by the shielding of the shielding plate 7 when the flat contact portions 315, 415 transmit signals. Furthermore, the structural strength of the tongue portion 22 can be improved by the assembly of the shielding plate 7. In addition, the contact parts 72 of the shielding plate 7 are extending downwardly to form vertical legs; that is, the contact parts 72 are exposed from the base portion 21 and in contact with the circuit board. Moreover, the shielding plate 7 comprises a plurality of hooks 73. The hooks 73 are extending outward from two sides of the plate body 71. When an electrical plug connector is mated with the electrical receptacle connector 100, elastic pieces at two sides of an insulated housing of the electrical plug connector are engaged with the hooks 73, and the elastic pieces would not wear against the tongue portion 22 of the electrical receptacle connector 100. Hence, the shielding plate 7 can be in contact with the metallic shell of the plug connector for conduction and grounding.

Furthermore, the electrical receptacle connector 100 further comprises a plurality of conductive sheets. The conductive sheets are metallic elongated sheets, an upper conductive sheet is above the base portion 21, and a lower conductive sheet is below the base portion 21. When an electrical plug connector is mated with the electrical receptacle connector 100, the front end of the metallic shell of the electrical plug connector is in contact with the conductive sheets, so that the metallic shell of the electrical plug connector and the metallic shell 11 of the electrical receptacle connector 100 can be connected with each other. Accordingly, the connection between the shells of the connectors can be grounded and the electromagnetic interference (EMI) during the signal transmission can be reduced by the conductive sheets.

Figure 8:
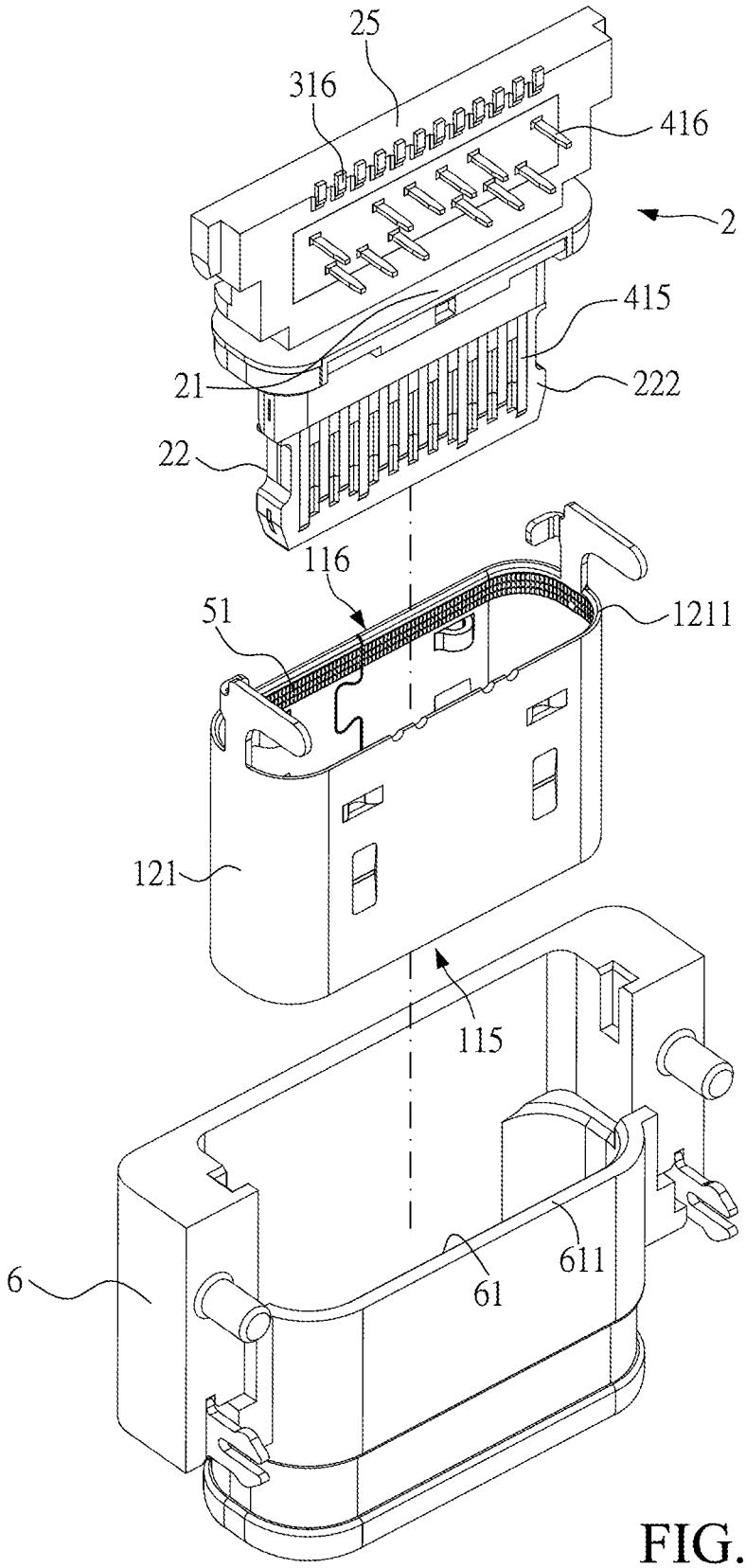
FIG. 8 illustrates an exploded view of an electrical receptacle connector according to a second embodiment of the instant disclosure.
Figure 9:
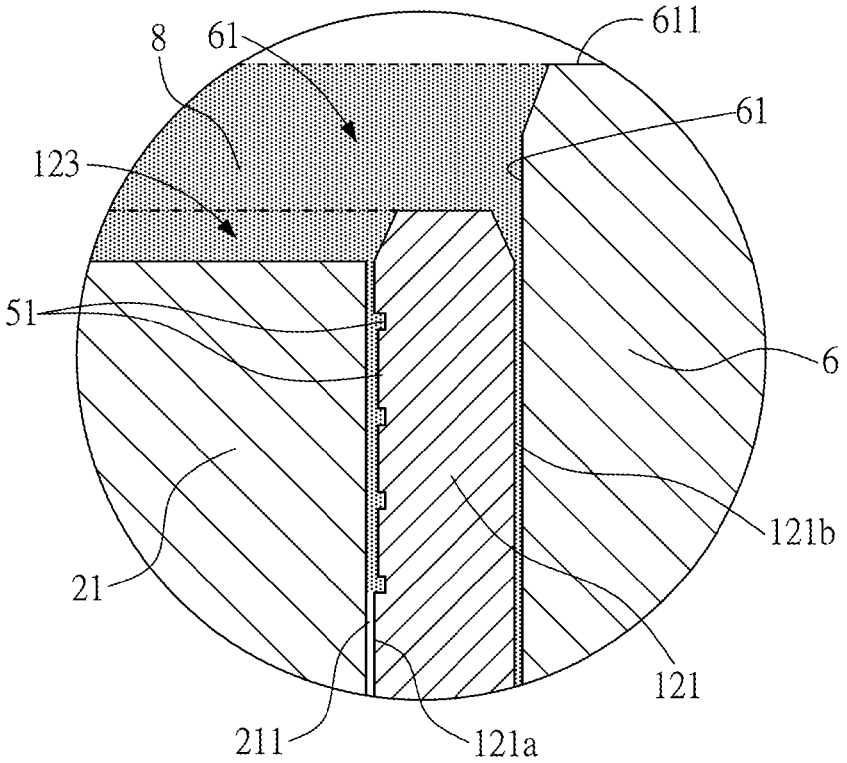
FIG. 9 illustrates an enlarged lateral view of the first texture region of the electrical receptacle connector of the second embodiment.

Please refer to FIGS. 8 and 9, illustrating an electrical receptacle connector 100 of a second embodiment of the instant disclosure. FIG. 8 illustrates an exploded view of the electrical receptacle connector. FIG. 9 illustrates an enlarged lateral view of the first texture region of the electrical receptacle connector. In this embodiment, the metallic shell 11 is further enclosed by an enveloping shell 6 to form a second glue recess 61. In this embodiment, the electrical receptacle connector 100 further comprises an enveloping shell 6. The enveloping shell 6 is a replacement for the case 124 of the first embodiment. In this embodiment, the enveloping shell 6 is a plastic shell. The enveloping shell 6 circularly encloses the shell body 121. An end portion 611 of the enveloping shell 6 corresponding to the rear end 116 of the shell body 121 is protruding from the lateral surface of the base portion 21 to form a second glue recess 61. The sealing member 8 can be filled into the second glue recess 61, and the sealing member 8 penetrates into the inner gap 211 and fills the first texture region 51.

Figure 10:
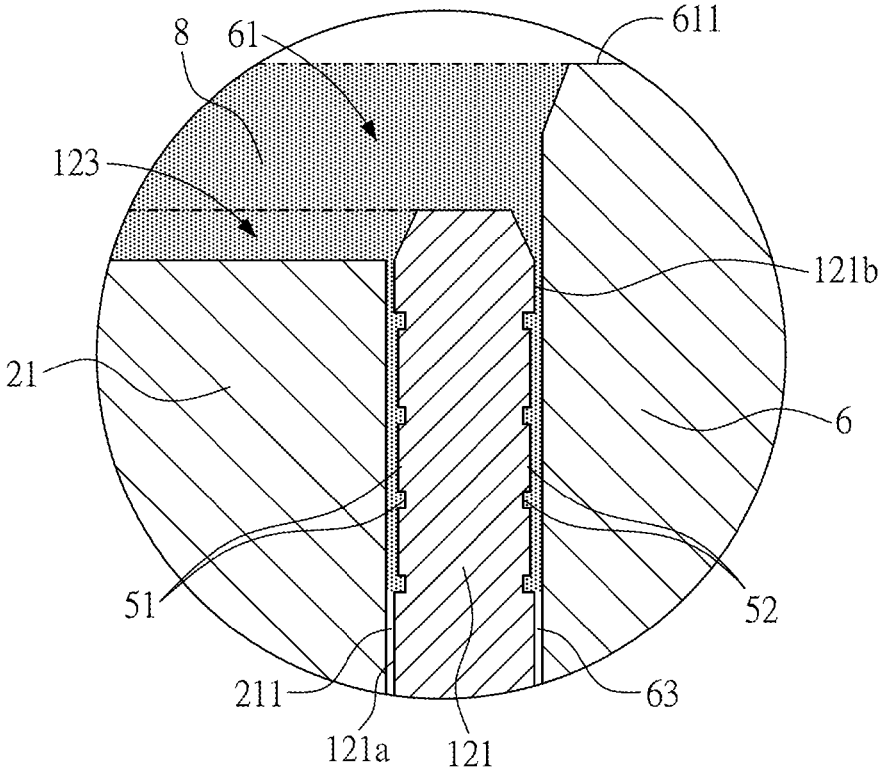
FIG. 10 illustrates another enlarged lateral view of the electrical receptacle connector having a second texture region.

Please refer to FIG. 10, illustrating another enlarged lateral view of the electrical receptacle connector having second texture region. In one embodiment, the shell body 121 further comprises a second texture region 52 annularly formed on an outer wall 121*b* of the shell body 121. An outer gap 63 is formed between an inner wall of the enveloping shell 6 corresponding to the rear end 116 of the shell body 121 and the outer wall 121*b* of the shell body 121. The second texture region 52 may be patterns formed by pressing techniques and may be aligned equidistantly or unequidistantly. The second texture region 52 may be aligned parallel (not overlapped) or nonparallel (overlapped), and the shape of the second texture region 52 may be rectangle, triangle, etc. It is understood that, the width of the second texture region 52 and the roughness of the pattern on the second texture region 52 can be altered according to glues with different viscosities. The second texture region 52 makes the outer wall 121*b* of the shell body 121 form a rough surface, so that the sealing member 8 can attach onto the second texture region 52 efficiently. Therefore, the sealing member 8 does not overflow into the front portion of the receptacle cavity 112, and the outer gap 63 can be sealed by the sealing member 8 properly. Hence, the second texture region 52 allows the sealing member 8 to attach onto the outer wall 121*b* of the shell body 121, and the sealing member 8 can cover the outer gap 63 completely to provide a reliable waterproof performance.

Figure 11:
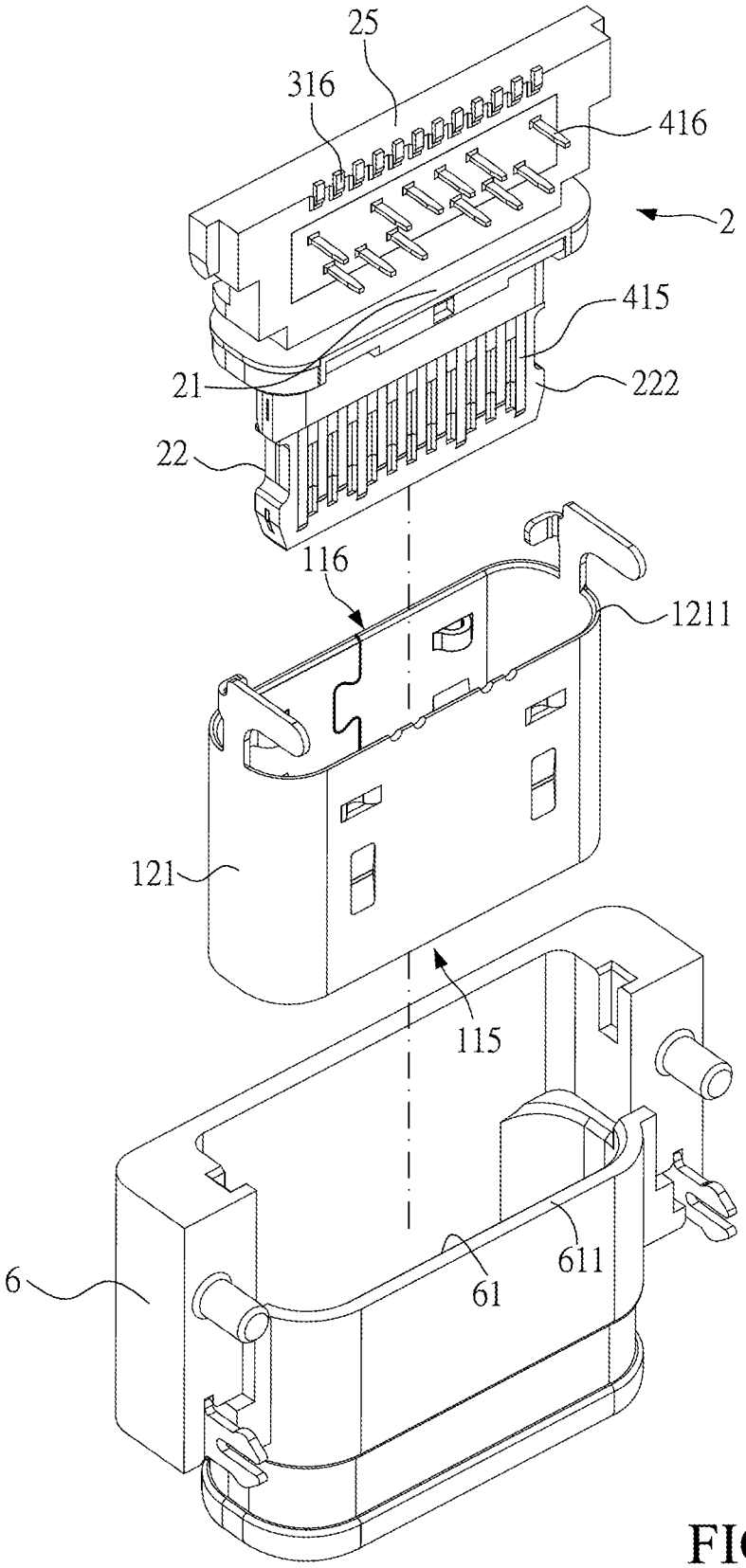
FIG. 11 illustrates an exploded view of an electrical receptacle connector according to a third embodiment of the instant disclosure.
Figure 12:
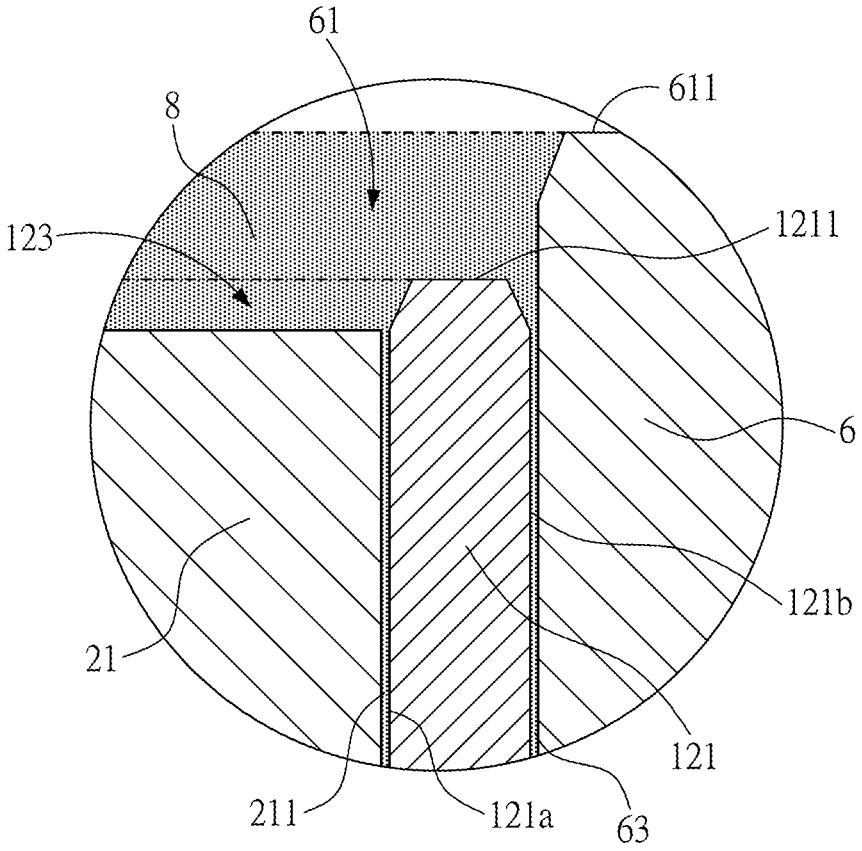
FIG. 12 illustrates an enlarged view of the electrical receptacle connector of the third embodiment.

Please refer to FIGS. 11 and 12, illustrating an electrical receptacle connector 100 of a third embodiment of the instant disclosure. FIG. 11 illustrates an exploded view of an electrical receptacle connector of the third embodiment. FIG. 12 illustrates an enlarged view of the electrical receptacle connector of the third embodiment. In this embodiment, the base portion 21 is located at an end portion 1211 of the shell body 121, and the rear end 116 of the shell body 121 is protruding from a lateral surface of the base portion 21 to form a first glue recess 123. The enveloping shell 6 circularly encloses the shell body 121. An end portion 611 of the enveloping shell 6 corresponding to the rear end 116 of the shell body 121 is protruding from the lateral surface of the base portion 21 to form a second glue recess 61, wherein the second glue recess 61 comprises the first glue recess 123. That is, the region of the second glue recess 61 for receiving the sealing member 8 contains the first glue recess 123.

When the sealing member 8 in liquid state fills into the second glue recess 61, the sealing member 8 penetrates into the insulated housing 2 and is distributed within the inner gap 211, so that the inner gap 211 is completely sealed by the sealing member 8. In addition, the outer gap 63 between the outer wall 121*b* of the shell body 121 and the inner wall of the enveloping shell 6 is completely filled by the sealing member 8. Therefore, the electrical receptacle connector 100 can provide a reliable waterproof performance.

As above, the first texture region makes the inner wall of the metallic shell form a rough surface, so that the sealing member can attach onto the first texture region efficiently. Therefore, the sealing member does not overflow into the front portion of the receptacle cavity, and the inner gap can be sealed by the sealing member properly. Hence, the first texture region allows the sealing member to attach onto the inner wall of the shell body, and the sealing member can cover the inner gap completely to provide a reliable waterproof performance. Furthermore, the second texture region makes the outer wall of the shell body form a rough surface, so that the sealing member can attach onto the second texture region efficiently. Therefore, the sealing member does not overflow into the front portion of the receptacle cavity, and the outer gap can be sealed by the sealing member properly. Hence, the second texture region allows the sealing member to attach onto the outer wall of the shell body, and the sealing member can cover the outer gap completely to provide a reliable waterproof performance.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180-degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a metallic shell comprising a shell body and a receptacle cavity defined through the shell body, wherein two ends of the shell body are respectively formed as an front end and a rear end;

an insulated housing received in the receptacle cavity, wherein the insulated housing comprises a base portion and a tongue portion extending from the base portion and an inner gap is between an inner wall of the shell body at the rear end and the base portion;

a plurality of first receptacle terminals held in the base portion and the tongue portion;

a plurality of second receptacle terminals held in the base portion and the tongue portion; and a first texture region annularly formed on the inner wall of the shell body, wherein the first texture region correspond to a periphery of an outer wall of the base portion and are distributed within the inner gap.

2. The electrical receptacle connector according to claim 1, wherein an end portion of the shell body at the rear end is protruded from a lateral surface of the base portion to form a first glue recess.

3. The electrical receptacle connector according to claim 2, further comprising a sealing member filled in the first glue recess, wherein the sealing member penetrates into the inner gap and fills the first texture region.

4. The electrical receptacle connector according to claim 1, further comprising an enveloping shell circularly enclosing the shell body, wherein an end portion of the enveloping shell corresponding to the rear end of the shell body is protruding from the lateral surface of the base portion to form a second glue recess.

5. The electrical receptacle connector according to claim 4, further comprising a sealing member filled in the second glue recess, wherein the sealing member penetrates into the inner gap and fills the first texture region.

6. The electrical receptacle connector according to claim 4, wherein an outer gap is between an inner wall of the enveloping shell corresponding to the rear end of the shell body and an outer wall of the shell body.

7. The electrical receptacle connector according to claim 6, further comprising a second texture region annularly formed on the outer wall of the shell body, wherein the second texture region correspond to an inner wall of the enveloping shell and are distributed within the outer gap.

8. The electrical receptacle connector according to claim 7, further comprising a sealing member filled in the second glue recess, wherein the sealing member penetrates into the outer gap and fills the second texture region.

9. The electrical receptacle connector according to claim 1, wherein the metallic shell further comprises a case circularly enclosing the shell body.

10. An electrical receptacle connector, comprising:

a metallic shell comprising a shell body and a receptacle cavity defined through the shell body, wherein two ends of the shell body are respectively formed as an front end and a rear end;

an insulated housing received in the receptacle cavity, wherein the insulated housing comprises a base portion and a tongue portion extending from one end of the base portion, the base portion is located at an end portion of the shell body, and the rear end of the shell body is protruding from a lateral surface of the base portion to form a first glue recess;

a plurality of first receptacle terminals held in the base portion and the tongue portion;

a plurality of second receptacle terminals held in the base portion and the tongue portion;

an enveloping shell circularly enclosing the shell body, wherein an end portion of the enveloping shell corresponding to the rear end of the shell body is protruding from the lateral surface of the base portion to form a second glue recess, wherein the second glue recess comprises the first glue recess; and a first texture region annularly on the inner wall of the shell body, wherein the first texture region corresponds to a periphery of an outer wall of the base portion and are distributed within the inner gap.

* * * * *